United States Patent [19]

Oldford

[11] 4,297,869

[45] Nov. 3, 1981

[54] APPARATUS FOR FABRICATING PULLEY RIMS

[75] Inventor: William G. Oldford, Lexington, Mich.

[73] Assignee: U.S. Industries, Inc., Oak Brook, Ill.

[21] Appl. No.: 73,617

[22] Filed: Sep. 10, 1979

[51] Int. Cl.[3] ..... B21D 43/04

[52] U.S. Cl. ..... 72/405; 29/159 R; 72/407; 72/451

[58] Field of Search ..... 72/405, 404, 407, 419, 72/451; 29/159 R

[56] References Cited

U.S. PATENT DOCUMENTS

| | | | |
|---|---|---|---|
| 2,827,225 | 3/1958 | Killian | 29/159 R |
| 2,869,223 | 1/1959 | Killian | 29/159 R |
| 2,892,431 | 6/1959 | Killian | 72/82 |
| 2,929,345 | 3/1960 | Zatyko | 72/378 |
| 3,087,531 | 4/1963 | Pacak | 29/159 R |
| 3,124,090 | 3/1964 | Zatyko | 72/453.01 |
| 3,128,539 | 4/1964 | Brooks | 29/159 R |
| 3,263,315 | 8/1966 | O'Brien | 29/159 R |
| 3,440,705 | 4/1969 | Johnson | 29/159 R |
| 3,548,628 | 12/1970 | Asari | 72/419 |
| 3,564,898 | 2/1971 | Stettler | 72/419 |
| 3,654,790 | 4/1972 | Zatko | 29/159 R |
| 3,688,717 | 9/1972 | Rudolph | 72/404 |
| 3,750,450 | 8/1973 | Sharp | 72/353 |
| 3,757,413 | 9/1973 | Craik | 29/159 R |
| 3,820,369 | 6/1974 | Tominaga | 29/159 R |
| 3,831,414 | 8/1974 | Haswell | 29/159 R |
| 3,837,200 | 9/1974 | Wolbert | 29/159 R |
| 3,851,366 | 12/1974 | Jacobs | 29/159 R |
| 3,935,627 | 2/1976 | Wolbert | 29/159 R |
| 3,945,102 | 3/1976 | Kotlar | 29/159 R |
| 3,953,995 | 5/1976 | Haswell | 29/159 R |
| 4,055,977 | 11/1977 | Haswell | 29/159 R |
| 4,064,724 | 12/1977 | Armstrong | 29/159 R |
| 4,138,776 | 2/1979 | Oldford | 29/159 R |

*Primary Examiner*—Gene P. Crosby

*Attorney, Agent, or Firm*—Harness, Dickey & Pierce

[57] ABSTRACT

An apparatus for manufacturing pulley rims has a first press, for initially shaping a pulley rim from a pulley rim blank, a second press, for final shaping of the pulley rim, and a clamping assembly for holding and transporting a pulley rim blank between the first press and the second press. Each of the first and second presses include a pair of dies with opposing frusto-conical portions, one of each pair of dies having a cylindrical forward extension which is adapted to extend into a central bore in the other of the pair of dies. The clamping assembly has a pair of semi-cylindrical clamping members with opposed clamping surfaces shaped to conform to the circumference of a finished pulley rim.

17 Claims, 5 Drawing Figures

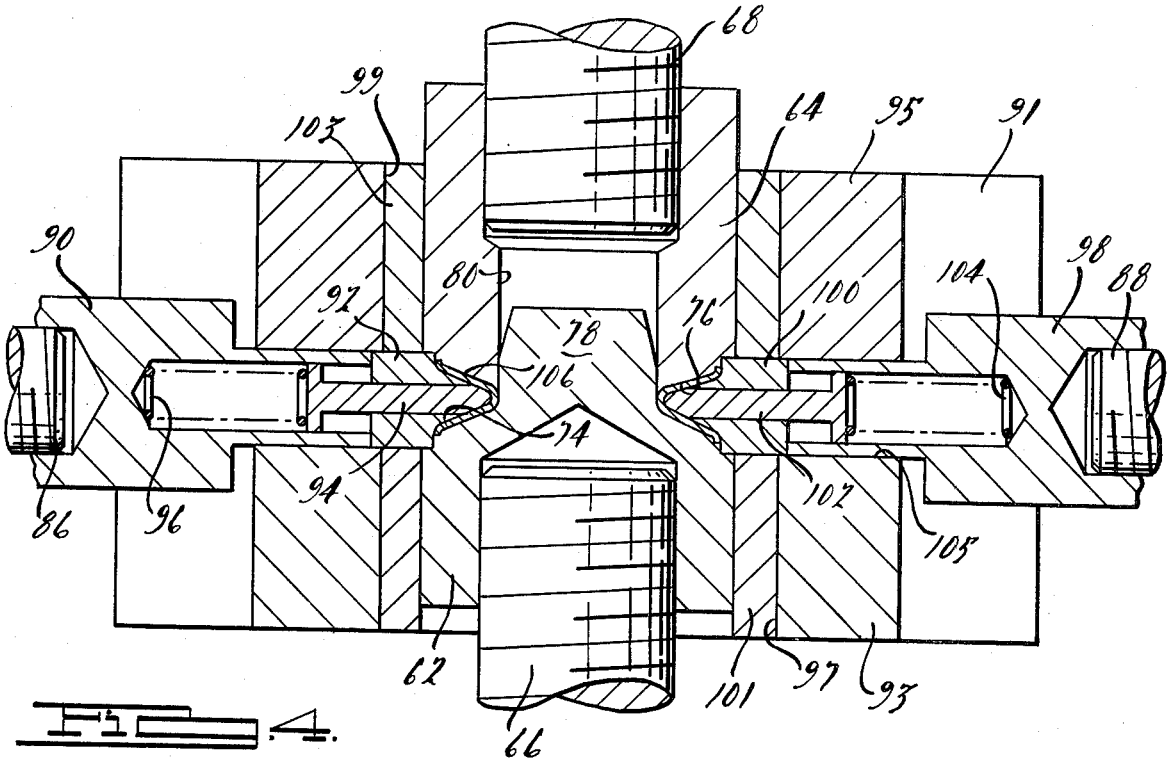
FIG. 4.
FIG. 3.
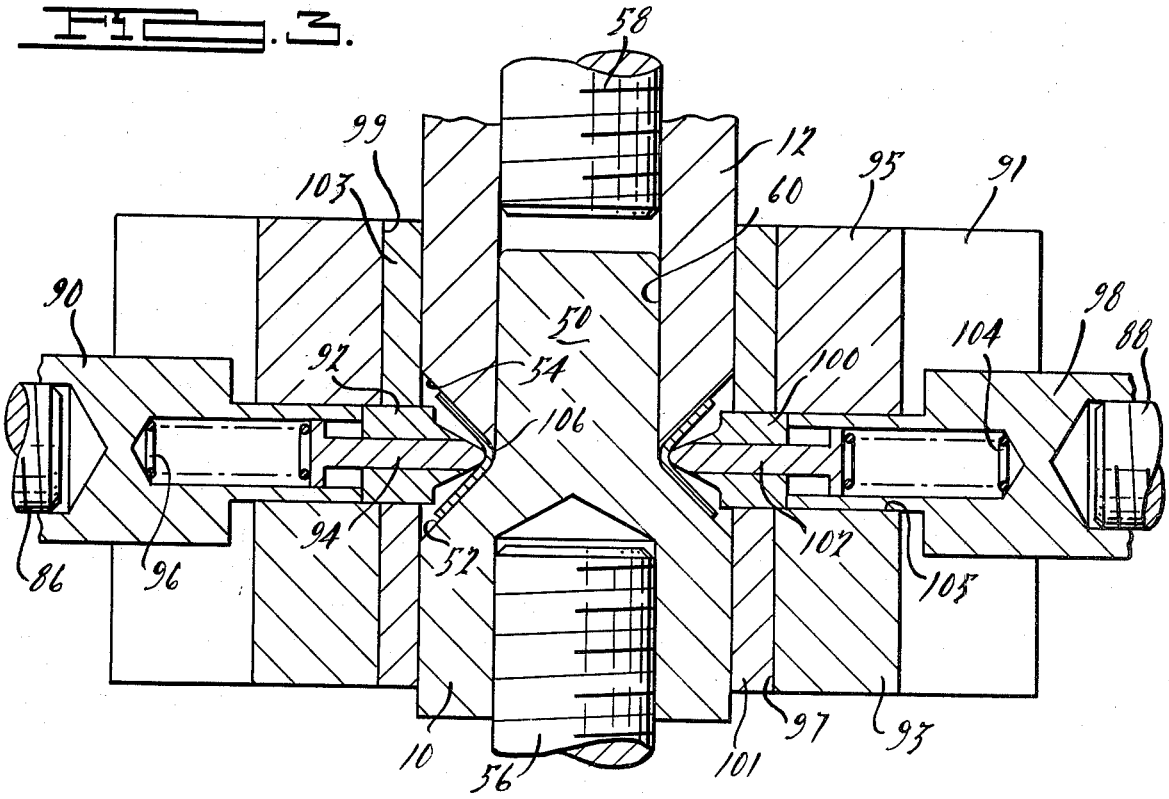

APPARATUS FOR FABRICATING PULLEY RIMS

DESCRIPTION OF THE INVENTION

The present invention relates to an apparatus for fabricating pulley rims from cylindrical pulley rim blanks.

Although many methods have been developed for fabricating pulleys of different sizes and shapes, a particularly advantageous method involves shaping cylindrically shaped blanks for fabrication of a pulley rim. The use of cylindrically shaped blanks for fabrication of the pulley rim substantially eliminates all waste and avoids operations such as casting, stamping, rolling, spinning, and slitting which are employed in various other methods for fabricating pulleys. My earlier U.S. Pat. No. 4,138,776, Feb. 13, 1979, for "Method of Fabricating Pulleys" discloses a one-step method for shaping a pulley rim wherein relatively movable die forming members are used to deform a cylindrically shaped blank of constant diameter to form a ring having a V-shaped cross section. Such pulley rims may then be assembled to a hub member to form a finished pulley. The apparatus of the present invention, however, is intended for making pulley rims in two steps. Thus, in use of the apparatus of the present invention, a pulley rim blank is shaped in two pressing steps to form a finished pulley rim which can then be assembled to a hub member to form a pulley.

Wherefore, it is an object of the present invention to provide an improved apparatus for fabricating pulley rims. Another object of the present invention is to provide an apparatus which can be economically manufactured and which also provides means for economically manufacturing quality pulley rims of V-shaped cross section from cylindrically shaped blanks. These and other objects, features and advantages of the present invention will be apparent from the following description and claims taken in conjunction with the accompanying drawings.

DESCRIPTION OF THE DRAWINGS

FIG. 3 is a horizontal sectional view, broken away, of the clamping member and the forming dies of the first press of the embodiment of the present invention of FIGS. 1 and 2, shown in operative association with a partially shaped pulley ring blank;

FIG. 4 is a horizontal sectional view, broken away, of the clamping member and forming dies of the second press of the embodiment of the present invention of FIGS. 1–3, in operative association with a finish-shaped pulley rim blank.

DESCRIPTION OF THE INVENTION

Figure 1:
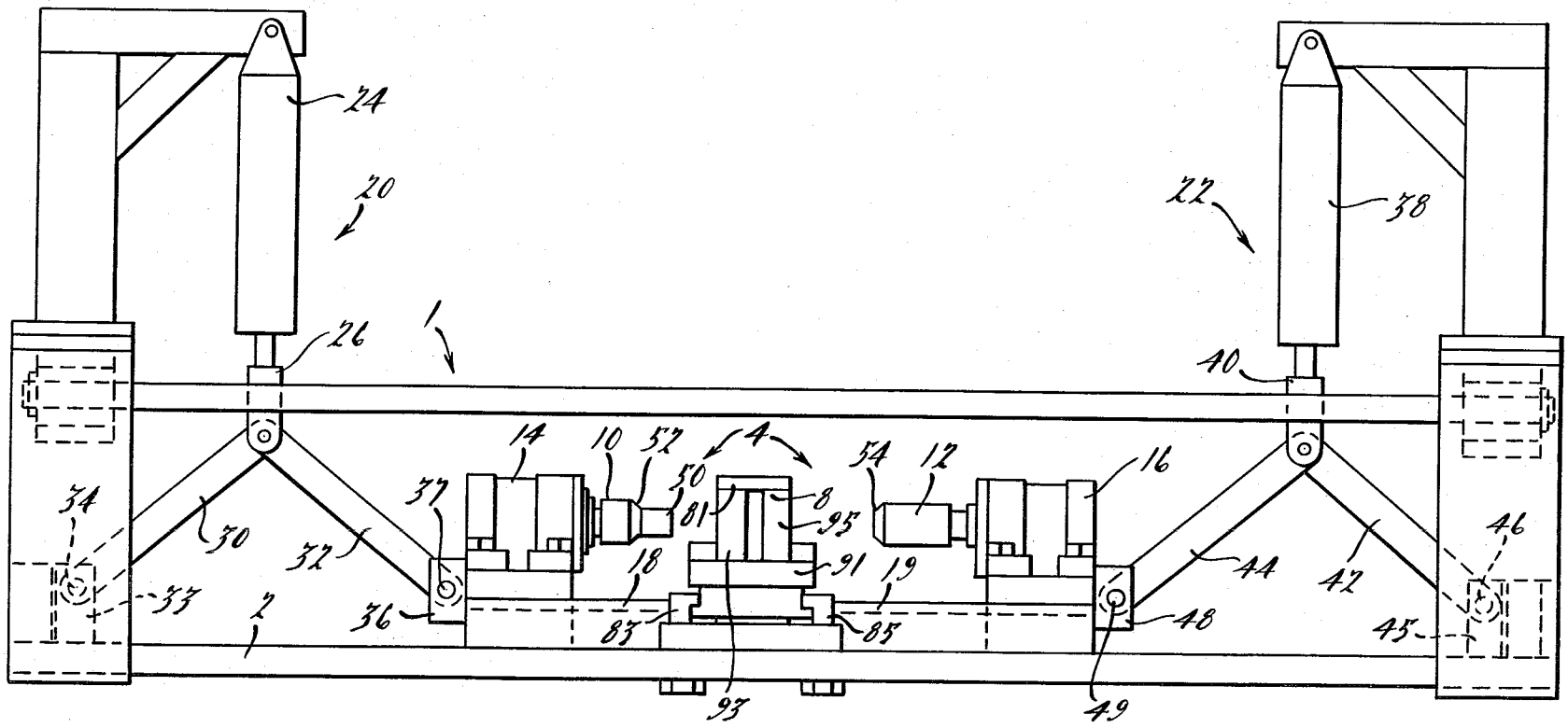
FIG. 1 is an elevational view of a frame, first press and clamping assembly of an apparatus of the present invention.

Referring now to the Figures, an apparatus for fabricating pulley rims of the present invention is shown and indicated generally by the numeral 1. Apparatus 1 has frame 2 with a plurality of suitable horizontal and vertical members which cooperate to support first press 4, second press 6 (not shown in FIG. 1), and clamping assembly 8. In operation, a pulley rim blank is held and transported by clamping assembly 8 between first press 4 which forms an initial shape into the pulley rim blank and second press 6 which forms the pulley rim back into its final shape. A plurality of hydraulic motors are selectively actuated by means of solenoid relay valves to operate apparatus 1. Clamping assembly 8 has ejection means for facilitating removal of the finished pulley rim from apparatus 1.

First press 4 comprises a pair of axially movable dies 10 and 12 which are respectively threadably mounted on the ends of pistons 56 and 58 of hydraulic motors 14 and 16, which in turn are respectively retained by gibs 18 and 19 which allow sliding movement in an axial direction toward and away from each other. Movement of hydraulic motors 14 and 16 is respectively accomplished by toggle linkages 20 and 22. Toggle linkage 20 is actuated by hydraulic motor 24 which has piston end 26 centrally pivotally connected to bifurcated toggle link 30 and toggle link 32 which are pivotally attached respectively to support 33 of frame 2 by pin 34 and to rear flange 36 of hydraulic motor 14 by pin 37. In an analogous manner, toggle linkage 22 is actuated by hydraulic motor 38 which has piston end 40 centrally pivotally connected to bifurcated toggle link 42 and toggle link 44 which are pivotally attached respectively to support 45 of frame 2 by pin 46 and to rear flange 48 of hydraulic motor 16 by pin 49. It is contemplated that hydraulic motors 24 and 38 will be simultaneously activated to extend or retract piston ends 26 and 40 to thereby slidably move hydraulic motors 14 and 16 into proximate or distal position with respect to each other.

The actual pressing or forming operation of first press 4 is carried out by means of hydraulic motors 14 and 16 with pistons 56 and 58 which threadably carry dies 10 and 12 and which actuate dies 10 and 12 towards each other to shape a pulley blank therebetween. Thus, die 10 has a cylindrical mandrel 50 which has an outer diameter slightly less than the inner diameter of the pulley rim blank and of the desired inner diameter of the finished pulley rim made therefrom. The working portion of die 10 is a frusto-conical portion 52 which cooperates with an opposing frusto-conical portion 54 on die 12 to press an initial V-shaped into a pulley rim blank disposed therebetween when dies 10 and 12 are simultaneously moved towards each other by piston 56 of hydraulic motor 14 and piston 58 of hydraulic motor 16. As best shown in FIG. 3, mandrel 50 is sized so as to fit in bore 60 of die 12 when hydraulic motor assemblies 14 and 16 are in their extended positions.

Second press 6 comprises a pair of axially movable dies 62 and 64 which are respectively threadably mounted on pistons 66 and 68 which are simultaneously actuated axially towards or away from each other by respective hydraulic motors 70 and 72 which are fixedly mounted on frame 2. Die 62 has frusto-conical portion 74 and die 64 has frusto-conical portion 76 which cooperate with each other to press a pulley rim blank in a partially finished condition into a finished shape. Die 62 has cylindrical mandrel 78 which is adapted to fit into bore 80 of die 64 upon extension of hydraulic pistons 66 and 68.

Figure 2:
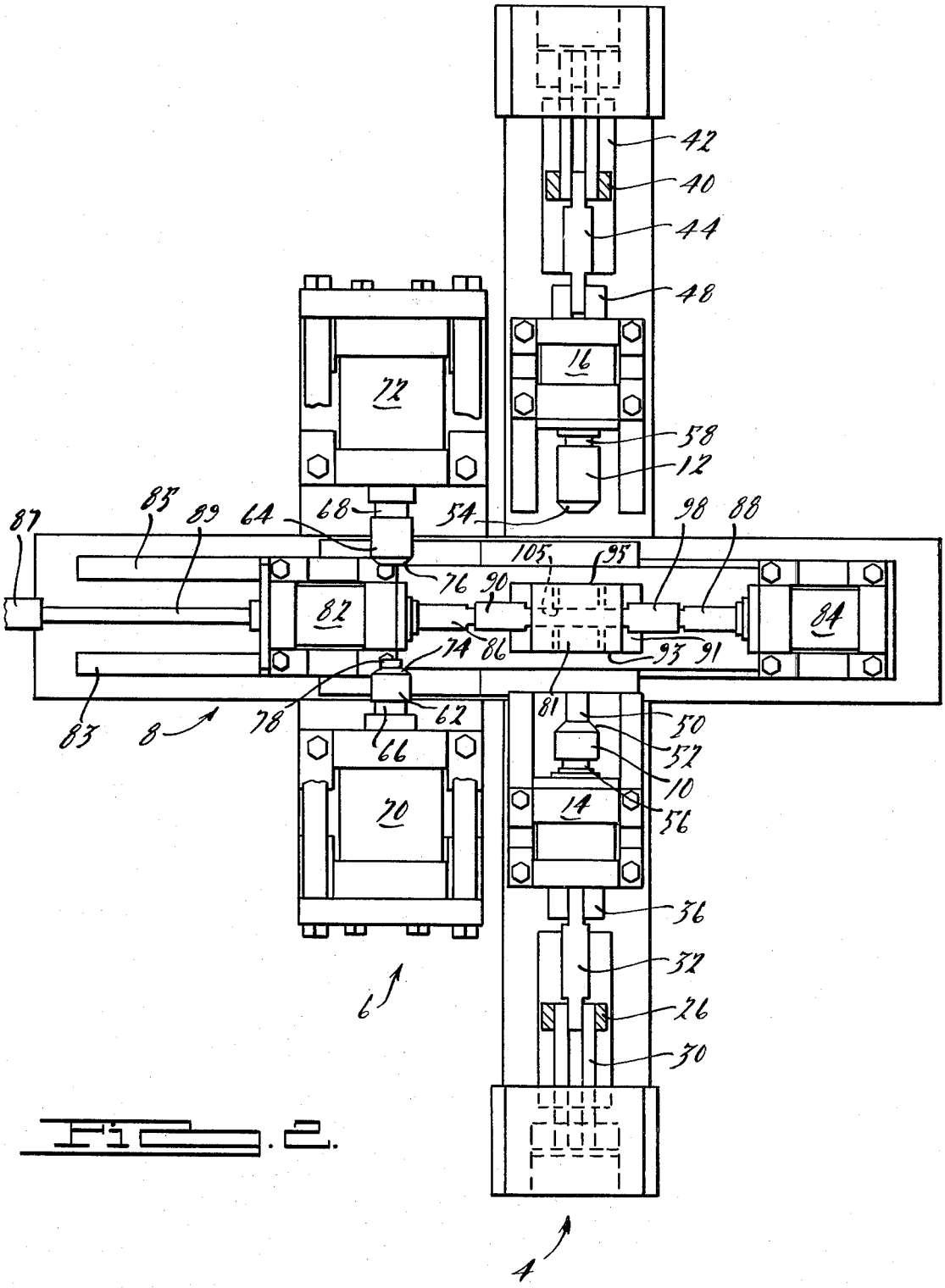
FIG. 2 is a plan view of an apparatus of the present invention including the frame, first press and clamping assembly of FIG. 1.

Clamping assembly 8 has a pair of hydraulic motors 82 and 84 which are adapted to move pistons 86 and 88 simultaneously towards or simultaneously away from each other. Hydraulic motors 82 and 84 are fixedly mounted with respect to each other and are slidably mounted with respect to frame 2 by gibs 83 and 85. Transfer of clamping assembly 8 from a first press position as shown in FIG. 2 to a second press position, i.e. movement of clamping assembly 8 to the left in FIG. 2, is accomplished by hydraulic motor 87 which has piston 89 connected to the left side portion of clamping assembly 8.

As shown in the Figures, clamping assembly 8 has a horizontally disposed base 91 and cap 81 with vertical side walls 93 and 95 disposed therebetween. Side walls 93 and 95 have respective aligned bores 97 and 99 with bushings 101 and 103 therein. Dies 10 and 12 extend through bores 97 and 99, i.e. through bushings 101 and 103, during the first pressing operation and dies 62 and 64 extend therethrough during the second pressing operation. As viewed in an axial direction with respect to pistons 86 and 88 of clamping assembly 8, vertical side walls 93 and 95 and bushings 101 and 103 define a vertical slot 105 which slidably receives movable clamping sleeves 92 and 100.

Each of clamping sleeves 92 and 100 is a semi-cylindrical sleeve having a facing portion with the shape of the radially outer face of the desired finished pulley rim. Sleeves 92 and 100 are respectively mounted on supports 90 and 98 which in turn are threadably mounted on the ends of pistons 86 and 88. Ejection pins 94 and 102 are respectively biased towards the pulley rim blank or finished pulley by springs 96 and 104 and serve to release the pulley rim 106 upon the simultaneous movement of clamping sleeves 92 and 100 away from each other after pulley rim 106 has been finish shaped.

Figure 5:
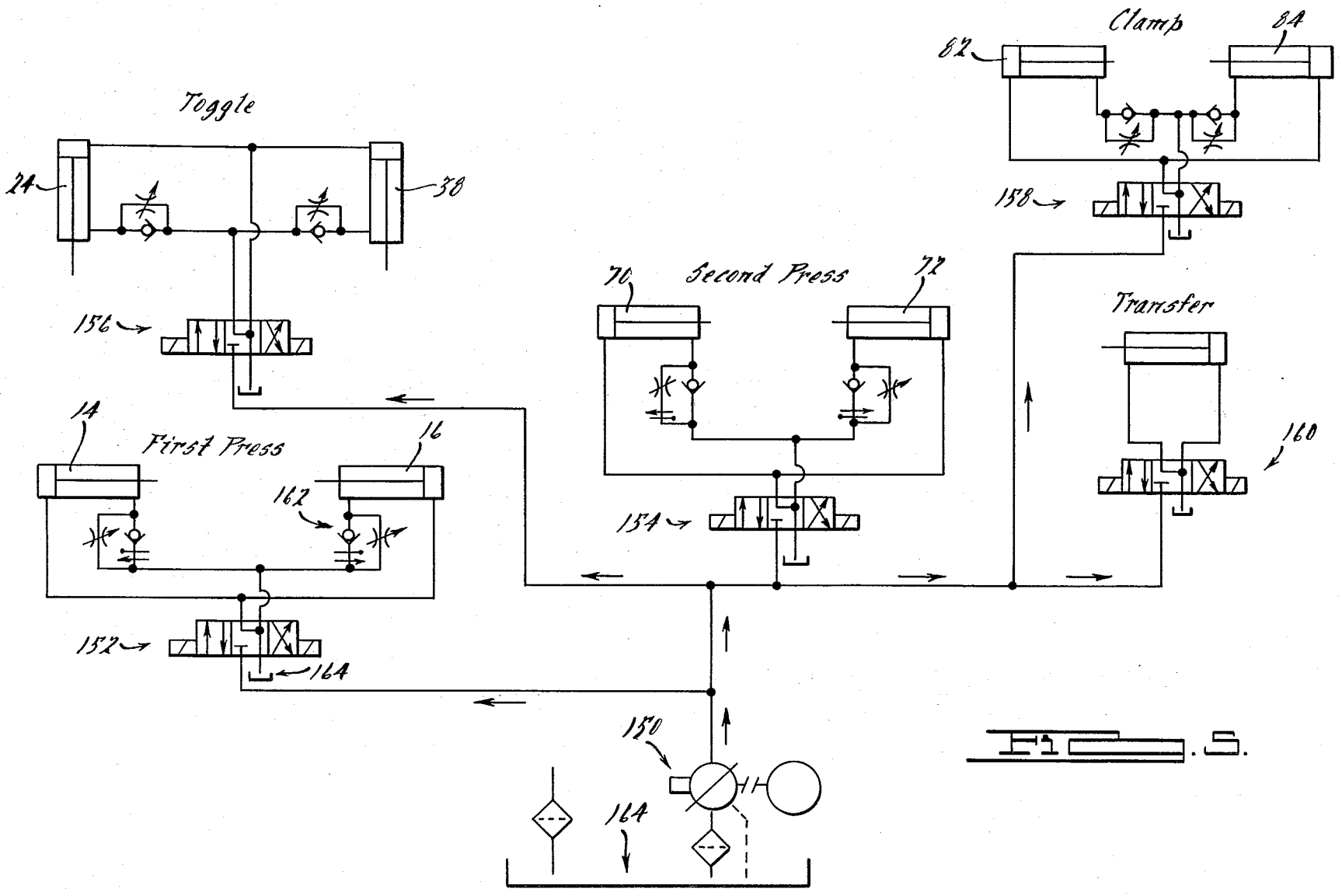
FIG. 5 is a schematic drawing illustrating the hydraulic control circuit of the apparatus of FIGS. 1–4.

Now referring to FIG. 5, a schematic diagram of the respective means for actuating the several hydraulic motors of the present invention is illustrated. As illustrated in FIG. 5, a hydraulic pump 150 provides hydraulic pressure to the inputs of each of relay valves 152, 154, 156, 158 and 160, which respectively control the first press, second press, toggle, clamp and transfer mechanisms. In the positions shown in the Figure, each valve is shown in a neutral or balanced condition. Upon shifting of a valve 152, 154 or 158 to the right or a valve 156 or 160 to the left, as in the manner of a conventional solenoid relay valve, hydraulic pressure passes through to the hydraulic cylinders of the motor or motors associated with the particular valve, to extend the piston of each motor while hydraulic fluid in the cylinder in opposition to extension of the piston passes through the valve to return to the hydraulic reservoir 164. On the other hand, when a valve 152, 154 or 158 is shifted to the left or a valve 156 or 160 is shifted to the right, hydraulic fluid passes through to the hydraulic cylinders of the motor or motors associated with the particular valve to retract the piston of each motor while hydraulic fluid in opposition to such retraction passes through the valve to return to the hydraulic reservoir 164. With the exception of the transfer motor, an adjustable valve (indicated in the first press by numeral 162) is provided in the return line to allow control of the speed of extension of the piston of each motor. The exact size of each motor will, of course, depend upon the size of the particular apparatus. However, by way of example, suitable hydraulic motor sizes, in inches, are: first press: $5\times2$; second press: $7\times4$; toggle motors: $2\times10$; clamping motors: $4\times4$; and transfer motor: $2\times18$.

Further understanding of the present invention will be obtained from the following description of the operation thereof. Thus, a pulley rim blank 106 is placed over mandrel 50 with the hydraulic pistons of hydraulic motors 24 and 38 in an upward position so that toggle linkages 20 and 22 have moved hydraulic motors 14 and 16 into a distal position with respect to each other. Then toggle linkages 20 and 22 are simultaneously actuated by hydraulic motors 24 and 38 to move hydraulic motors 14 and 16 into a proximate position. Clamping assembly 8 must be located in the first pressing position (as shown in FIG. 2), but sleeves 92 and 100 are at this time withdrawn to permit entry of pulley rim blank 106. Then, hydraulic motors 14 and 16 are simultaneously actuated to move dies 10 and 12 into pressing position until the position shown in FIG. 3 is obtained. After the actuation of dies 10 and 12, hydraulic motor assemblies 82 and 84 are simultaneously actuated to move pistons 86 and 88 and, hence, sleeves 92 and 100 towards each other and into engagement with the radially outer surface of pulley blank 106. As best shown in FIG. 3, sleeves 92 and 100 are positioned to hold pulley rim blank 106 whereupon hydraulic motors 14 and 16 are again actuated to withdraw dies 10 and 12 and the toggle linkages are actuated to further withdraw dies 10 and 12.

After the completion of the first forming step, clamping assembly 8 is transferred from the first forming position as shown in FIGS. 2 and 3 to the second or final forming position by moving to the left in FIG. 2 to locate pulley rim blank 106, now partially formed, in axial alignment with dies 62 and 64. Then dies 62 and 64 are simultaneously pressed toward each other by hydraulic motors 70 and 72 until obtaining the position shown in FIG. 4 whereupon the final finished form of pulley rim blank 106 is obtained. Finally, dies 62 and 64 are withdrawn by hydraulic motors 70 and 72 and clamping assembly 8 is transferred back to the first forming location by hydraulic motor 87, whereupon hydraulic motors 82 and 84 are activated to withdraw sleeves 92 and 100 to release the finished pulley rim 106. Release of pulley rim 106 is aided by ejection pins 94 and 102.

Thus, it is apparent that there is illustrated herein an apparatus for forming a pulley rim member which is suitable for assembly to a central hub member to form a durable pulley construction. It is further apparent that the apparatus of the present invention is easily adaptable to form various sizes of pulley rim members. Thus, dies 10 and 12 and 62 and 64 as well as cylindrical sleeves 92 and 100 can be changed to allow for manufacture of different sized pulley rims. Further, the apparatus of the present invention does not require the use of rollers or cutters and requires a minimum amount of maintenance and adjustment in use. Of course, production may be easily changed between different size pulley rims by switching die members and, if necessary, cylindrical sleeves. Of course, since pulley rim members are fabricated separately from the hub members, it is an advantage of the present machine that a mixture of pulley rim members having similar outer diameters but different shaft diameters can be easily produced. Thus, it will be apparent that the embodiment disclosed above is well calculated to provide the advantages and features of the present invention.

While a specific embodiment of the present invention has been disclosed herein, it will be appreciated that the invention is subject to variations and alternative embodiments. For example, other suitable motors could be substituted for the hydraulic motors and other than V-shaped grooves could be formed in the pulley blank. Such variations and alternative embodiments are contemplated to be within the broad scope of the invention which is intended to be limited by the appended claims.

What is claimed is:

1. An apparatus for manufacturing a pulley rim from a cylindrical pulley rim blank comprising a first press having a pair of opposed dies with frusto-conical portions thereon;

a second press having a pair of opposed dies with frusto-conical portions thereon;

clamping means for transporting said pulley rim blank from said first press to said second press;

said claming means including a clamping assembly and means for moving said clamping assembly between a first position wherein said rim blank is axially aligned with said first press and a second position wherein said rim blank is axially aligned with said second press; and a frame supporting said first press, second press, and said clamping means for transporting said pulley rim blank.

2. An apparatus as in claim 1 wherein one of said pair of dies of said first press has a first cylindrical forward portion and the other of said pair of dies has a first bore adapted to receive said first cylindrical forward portion.

3. An apparatus as in claim 1 wherein one of said pair of dies of said second press has a cylindrical forward portion and the other of said pair of dies of said second press has a bore adapted to receive said cylindrical forward portion.

4. An apparatus as in claim 2 wherein one of said pair of dies of said second press has a second cylindrical forward portion and the other of said pair of dies of said second press has a second bore adapted to receive said second cylindrical forward portion.

5. An apparatus as in claim 1 wherein said first press includes a pair of hydraulic motors, each connected to one of said dies of said first press.

6. An apparatus as in claim 5 wherein each of said hydraulic motors is slidably mounted on said frame and wherein each of said hydraulic motors is connected to a toggle linkage adapted to move each said motor toward and away from the other said motor.

7. An apparatus as in claim 6 wherein each said toggle linkage is centrally connected to a hydraulic piston.

8. An apparatus as in claim 1 wherein said second press includes a pair of hydraulic motors, each connected to one of said dies of said second press.

9. An apparatus as in claim 5 wherein said second press includes a pair of hydraulic motors, each connected to one of said dies of said second press.

10. An apparatus as in claim 1 wherein each of said dies is removably mounted on said first and second presses.

11. An apparatus as in claim 9 wherein each of said dies is removably mounted on one of said hydraulic motors.

12. An apparatus as in claim 1 wherein said clamping assembly includes a pair of generally opposed semi-cylindrical sleeve members, each having a facing surface of a shape corresponding to the radially outer face of a pulley rim.

13. An apparatus as in claim 12 wherein said clamping assembly includes a pair of vertical walls having aligned apertures therein each adapted to selectively freely receive one die of each of said pairs of opposed dies, said vertical walls defining a slot therebetween adapted to slidably receive said semi-cylindrical sleeve members.

14. An apparatus as recited in claim 13 wherein a bushing is located in each of said bores of said vertical walls.

15. An apparatus as in claim 13 wherein each of said cylindrical sleeve members is connected to a hydraulic motor adapted to move said cylindrical sleeve member into and out of clamping engagement with a pulley rim blank.

16. An apparatus as in claim 15 wherein each of said cylindrical sleeve members has a bore adapted to receive an ejection pin adapted to release said pulley rim from each of said cylindrical sleeve members when not in clamping engagement therewith.

17. An assembly as in claim 16 wherein said clamping assembly is slidably attached to said frame and said means for moving said clamping assembly includes a hydraulic motor attached thereto.

* * * * *

UNITED STATES PATENT AND TRADEMARK OFFICE

CERTIFICATE OF CORRECTION

PATENT NO. : 4,297,869
DATED : November 3, 1981
INVENTOR(S) : William G. Oldford It is certified that error appears in the above-identified patent and that said Letters Patent are hereby corrected as shown below:

| | | |
|---|---|---|
| Column 1, | line 53 | "ring" should be --rim--. |
| Column 2, | line 4 | "back" should be --blank--. |
| Column 2, | line 45 | "V-shaped" should be --V-shape--. |
| Column 5, | line 12 | "claming" should be --clamping--. |

Signed and Sealed this

*Fourth* Day of *May 1982*

[SEAL]

*Attest:*

GERALD J. MOSSINGHOFF

*Attesting Officer*

*Commissioner of Patents and Trademarks*